US008585344B2

(12) United States Patent
Sharp

(10) Patent No.: US 8,585,344 B2
(45) Date of Patent: Nov. 19, 2013

(54) ADJUSTABLE-WIDTH PALLET AND PRODUCT PROTECTOR

(76) Inventor: Geoffrey R. Sharp, Visalia, CA (US)

( * ) Notice: Subject to any disclaimer, the term of this patent is extended or adjusted under 35 U.S.C. 154(b) by 0 days.

(21) Appl. No.: 13/251,541

(22) Filed: Oct. 3, 2011

(65) Prior Publication Data

US 2013/0084154 A1 Apr. 4, 2013

(51) Int. Cl.
*B66F 9/14* (2006.01)

(52) U.S. Cl.
USPC ..... 414/667; 414/785; 187/237

(58) Field of Classification Search
USPC ..... 414/785, 607, 662–671, 629; 187/274, 187/237
See application file for complete search history.

(56) References Cited

U.S. PATENT DOCUMENTS

| | | | | | |
|---|---|---|---|---|---|
| 2,668,602 | A | * | 2/1954 | Cusbman | 414/667 |
| 2,847,138 | A | | 8/1958 | Backofen et al. | |
| 2,956,701 | A | | 10/1960 | Larson | |
| 3,122,252 | A | * | 2/1964 | Jones | 414/785 |
| 3,232,380 | A | | 2/1966 | Hansen | |
| 3,272,287 | A | | 9/1966 | Easton | |
| 3,826,392 | A | | 7/1974 | Farley | |
| 4,102,464 | A | | 7/1978 | Schuster | |
| D249,663 | S | | 9/1978 | Willett | |
| 4,239,446 | A | * | 12/1980 | Vucinic | 414/785 |
| 4,421,449 | A | | 12/1983 | Cotton | |
| 4,533,290 | A | * | 8/1985 | Hackauf | 414/667 |
| 4,619,579 | A | * | 10/1986 | Frison | 414/607 |
| 4,708,576 | A | | 11/1987 | Conley | |
| D297,848 | S | | 9/1988 | Burenga | |
| 5,096,363 | A | * | 3/1992 | Weinert et al. | 414/667 |
| 5,139,385 | A | * | 8/1992 | Chase et al. | 414/667 |
| 5,618,159 | A | | 4/1997 | Wilson | |
| 5,807,060 | A | * | 9/1998 | Hamlik | 414/668 |
| 6,533,526 | B2 | | 3/2003 | Lindgren et al. | |
| 6,902,039 | B2 | * | 6/2005 | Kunch | 187/222 |
| D535,805 | S | | 1/2007 | Stark | |
| 7,195,105 | B2 | | 3/2007 | Tygard | |
| 7,244,092 | B1 | * | 7/2007 | Darst | 414/785 |
| D551,423 | S | | 9/2007 | Kodama et al. | |
| 7,730,599 | B2 | | 6/2010 | Tyree | |
| 7,909,563 | B2 | * | 3/2011 | Prentice | 414/667 |

(Continued)

FOREIGN PATENT DOCUMENTS

EP 0478245 A1 4/1992

OTHER PUBLICATIONS

Written Opinion and International Search Report dated Oct. 16, 2012, as issued in corresponding International Patent Application No. PCT/US2012/028884, filed Mar. 13, 2012.

*Primary Examiner* — Jonathan Snelting
(74) *Attorney, Agent, or Firm* — Maier & Maier, PLLC

(57) ABSTRACT

An adjustable width pallet and product protector for a lift truck having a first outer L-shaped fork, a first inner L-shaped fork, a second outer L-shaped fork, and a second inner L-shaped fork. The protector can include a first horizontally elongated plate, a second horizontally elongated plate disposed rearwardly of the first horizontally elongated plate, a first outer mounting plate disposed rearwardly of and coupled to the first horizontally elongated plate, a first inner mounting plate disposed rearwardly of and slidably coupled to the first horizontally elongated plate, a second outer mounting plate disposed rearwardly of and coupled to the second horizontally elongated plate, and a second inner mounting plate disposed rearwardly of and slidably coupled to the second horizontally elongated plate.

8 Claims, 6 Drawing Sheets

(56) References Cited

U.S. PATENT DOCUMENTS

| | | | | |
|---|---|---|---|---|
| 2003/0206792 | A1 | 11/2003 | Kunch | |
| 2005/0196265 | A1 | 9/2005 | Moore et al. | |
| 2009/0008951 | A1 | 1/2009 | Whetstine et al. | |
| 2009/0116945 | A1* | 5/2009 | White et al. | 414/667 |
| 2010/0101895 | A1 | 4/2010 | Collins et al. | |
| 2011/0139546 | A1 | 6/2011 | Look | |

* cited by examiner

ADJUSTABLE-WIDTH PALLET AND PRODUCT PROTECTOR

BACKGROUND

Lift trucks, also known as forklifts, are commonly used in warehousing, storage, and similar applications to transport packaged materials between locations, and to raise and stack packaged materials for storage. To facilitate transporting and lifting the materials, such materials are typically packaged and disposed on top of a pallet. Commonly used pallets are constructed from wood and have a bottom deck and a top deck coupled to a plurality of parallel stringers disposed therebetween, with openings provided between the stringers. A pallet can have a pair of stringers disposed at the edges of the pallet, and a third stringer disposed substantially halfway between the pair of stringers. Forklifts have a pair of movable L-shaped members, or forks, that are inserted into the openings. Once the forks are disposed within the openings, the forklift can lift and transport the pallet.

During operations, forklifts can impact the pallet with the vertical portions of the forks. The force of these impacts is applied to the top deck of the pallet and to the goods disposed on top of the pallet and that may be overhanging the pallet. Consequently, individuals and businesses suffer significant losses due to product damage, pallet damage, as well as due to the labor involved in replacing pallets and products and restacking products on undamaged pallets.

Certain forklifts are provided with a "single-double" fork configuration, which allows the forklift to engage both single-width pallets, double-width pallets as well as multiple single-width pallets by including at least four forks and adjusting the distance between the forks. A pallet and product damage protection solution that is adaptable for forklifts having multiple adjustable forks is therefore desired.

SUMMARY

According to at least one exemplary embodiment, an adjustable width pallet and product protector for a lift truck is disclosed. The protector can include a first horizontally elongated plate, a second horizontally elongated plate disposed rearwardly of the first horizontally elongated plate, a first outer mounting plate disposed rearwardly of and coupled to the first horizontally elongated plate, a first inner mounting plate disposed rearwardly of and slidably coupled to the first horizontally elongated plate, a second outer mounting plate disposed rearwardly of and coupled to the second horizontally elongated plate, and a second inner mounting plate disposed rearwardly of and slidably coupled to the second horizontally elongated plate.

BRIEF DESCRIPTION OF THE FIGURES

FIG. 2*a* is an exploded isometric view of another exemplary embodiment of a pallet protector.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1B:
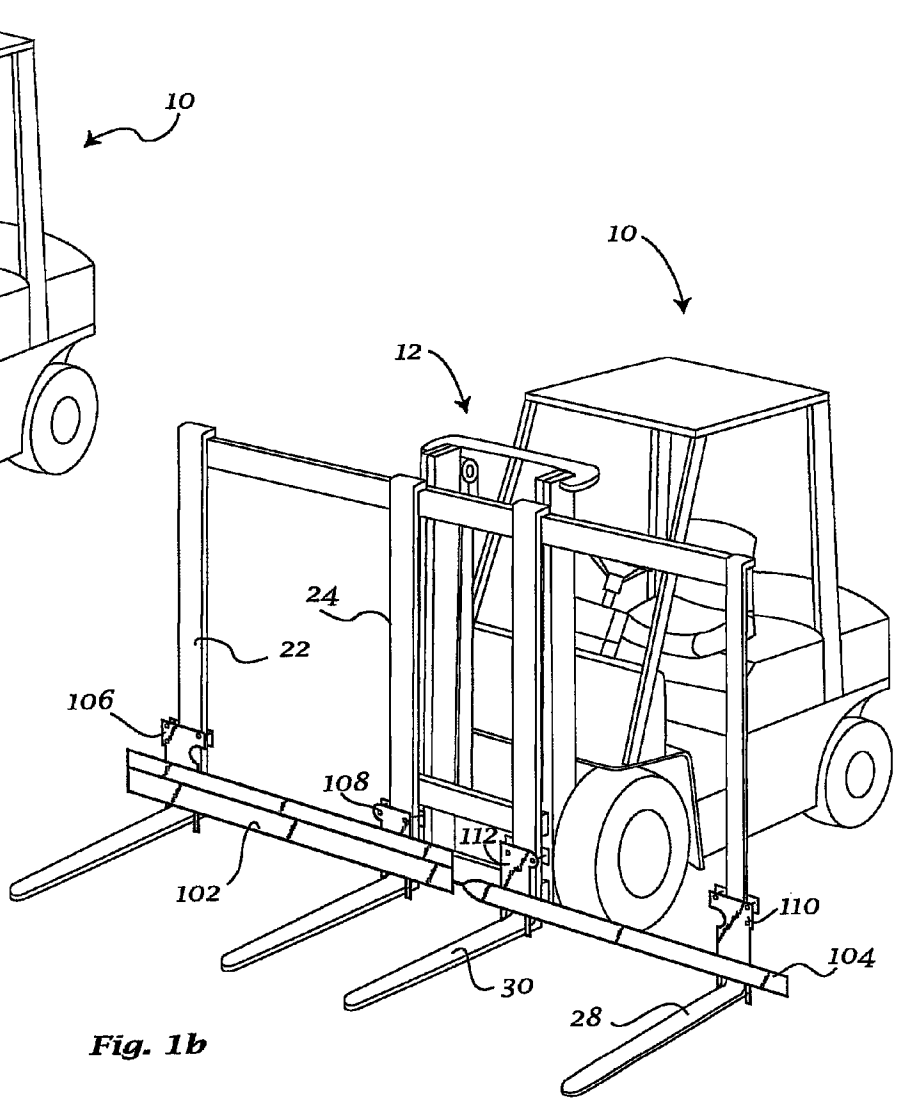
FIG. 1*b* shows an exemplary embodiment of an adjustable width pallet and product protector attached to a lift truck in an extended configuration.
Figure 1A:
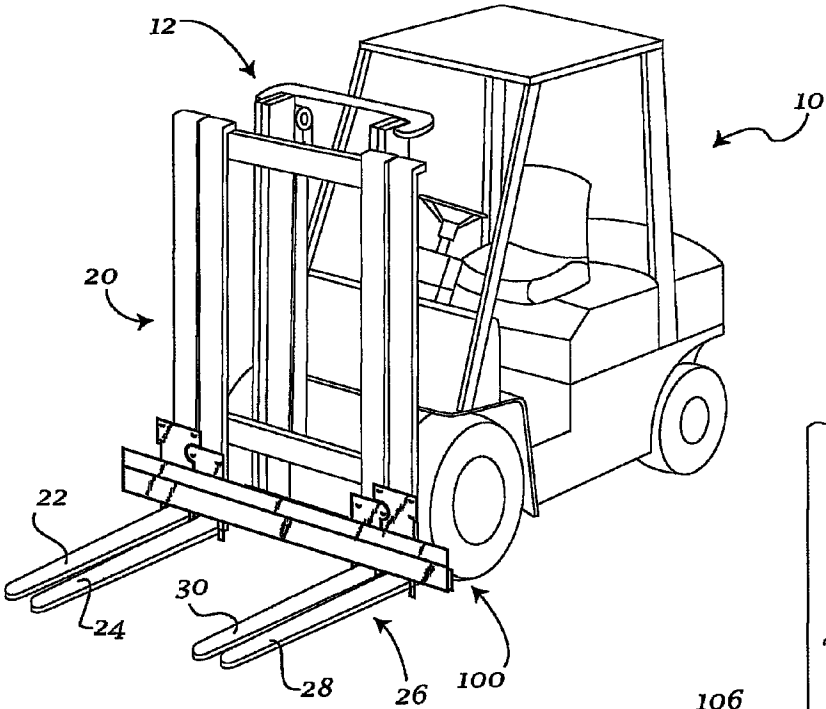
FIG. 1*a* shows an exemplary embodiment of an adjustable width pallet and product protector attached to a lift truck in a retracted configuration.
Figure 2A:
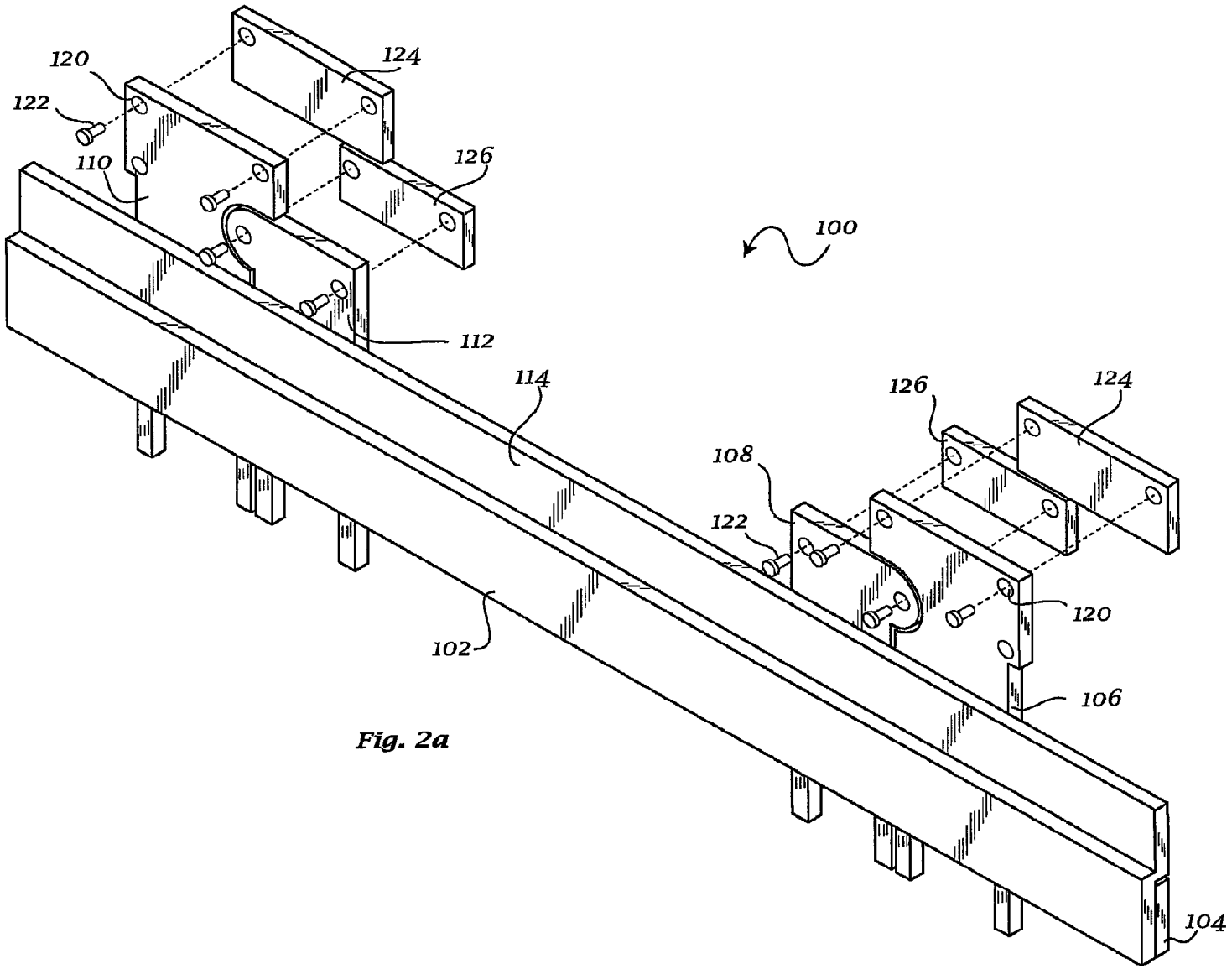
FIG. 2*a* is a front isometric view of an exemplary embodiment of an adjustable width pallet and product protector in a retracted configuration.
Figure 2B:
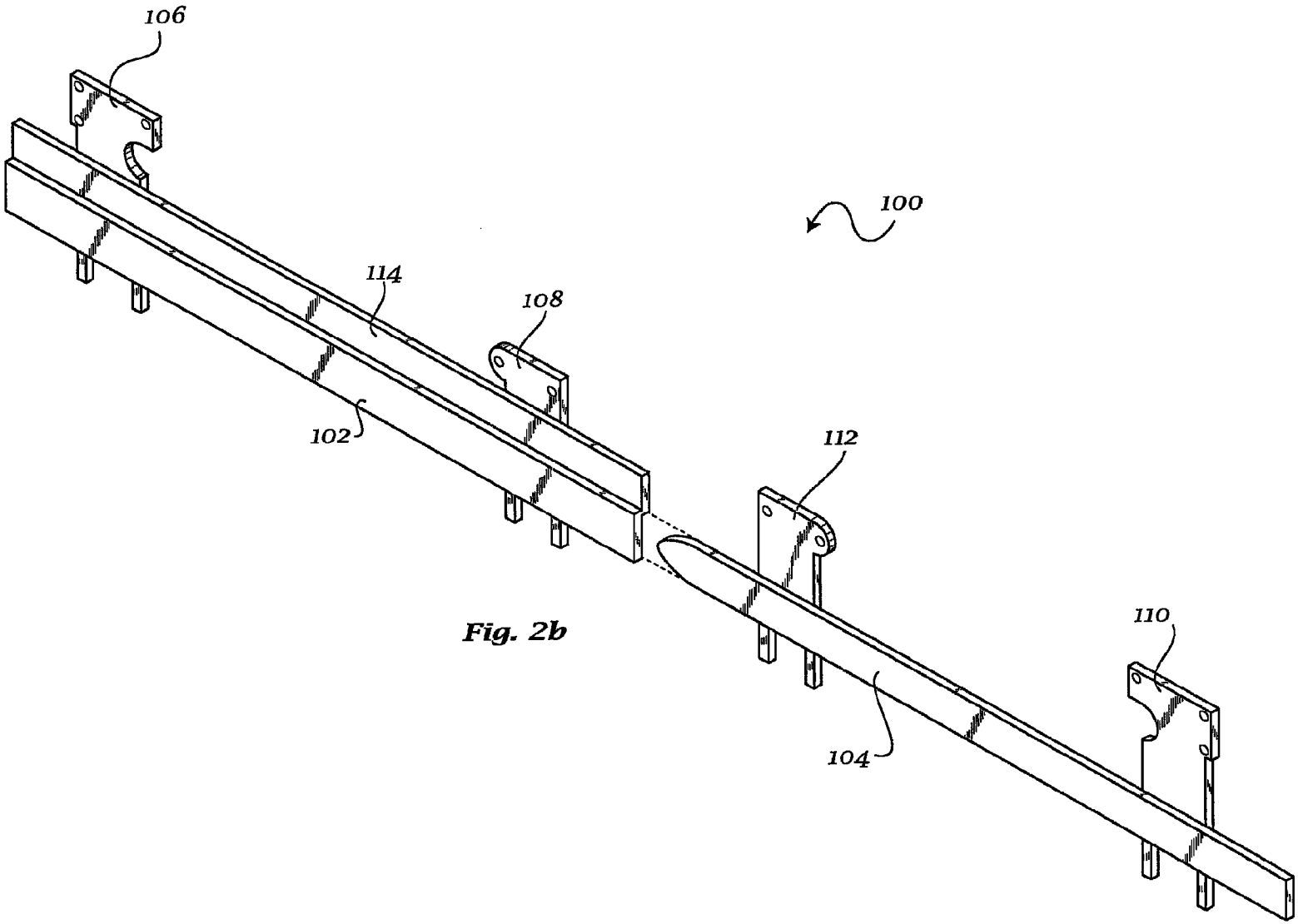
FIG. 2*b* is a front isometric view of an exemplary embodiment of an adjustable width pallet and product protector in an extended configuration.
Figure 3A:
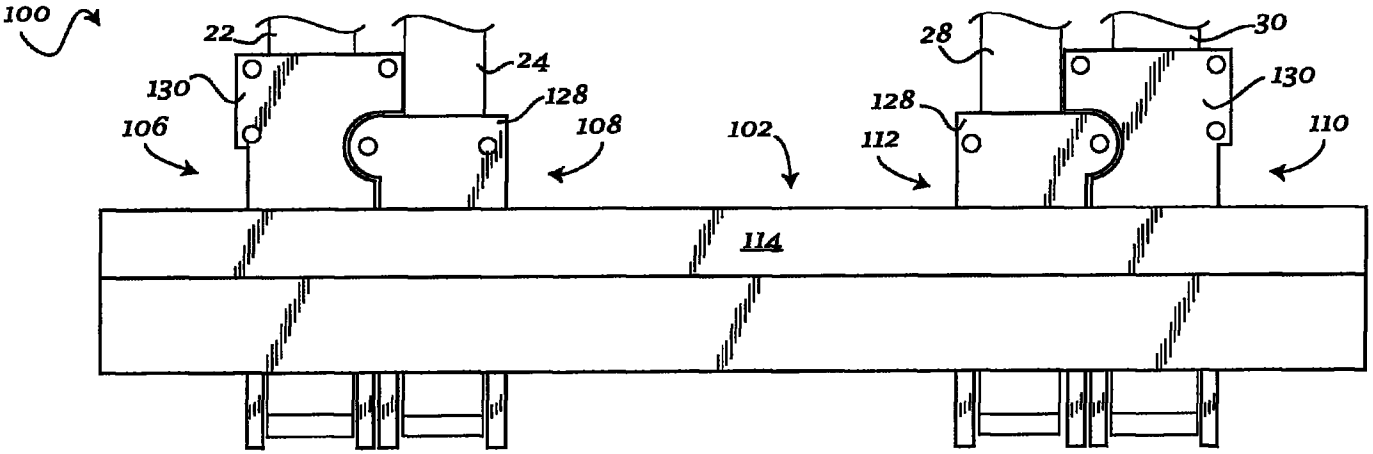
FIG. 3*a* is a front elevational view of an exemplary embodiment of an adjustable width pallet and product protector in a retracted configuration.
Figure 3B:
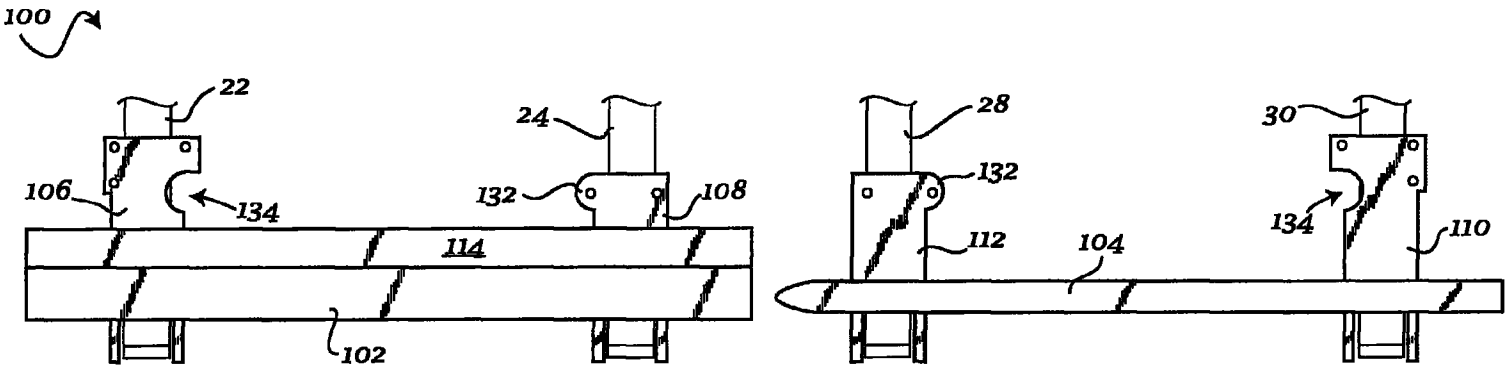
FIG. 3*b* is a front elevational view of an exemplary embodiment of an adjustable width pallet and product protector in an extended configuration.
Figure 4A:
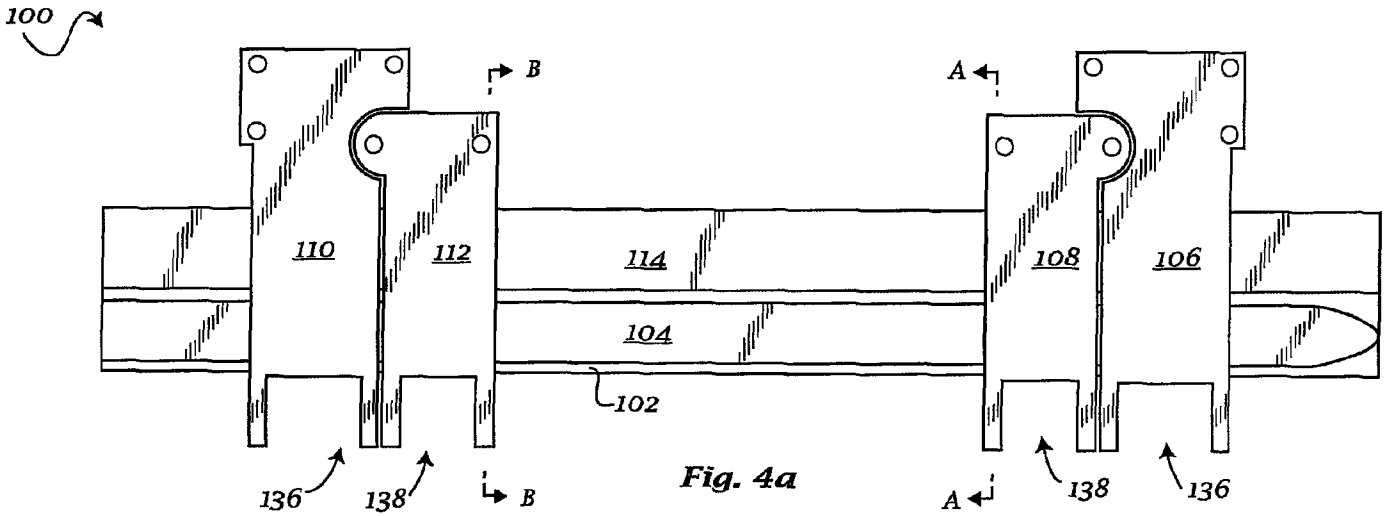
FIG. 4*a* is a rear elevational view of an exemplary embodiment of an adjustable width pallet and product protector in a retracted configuration.
Figure 4B:
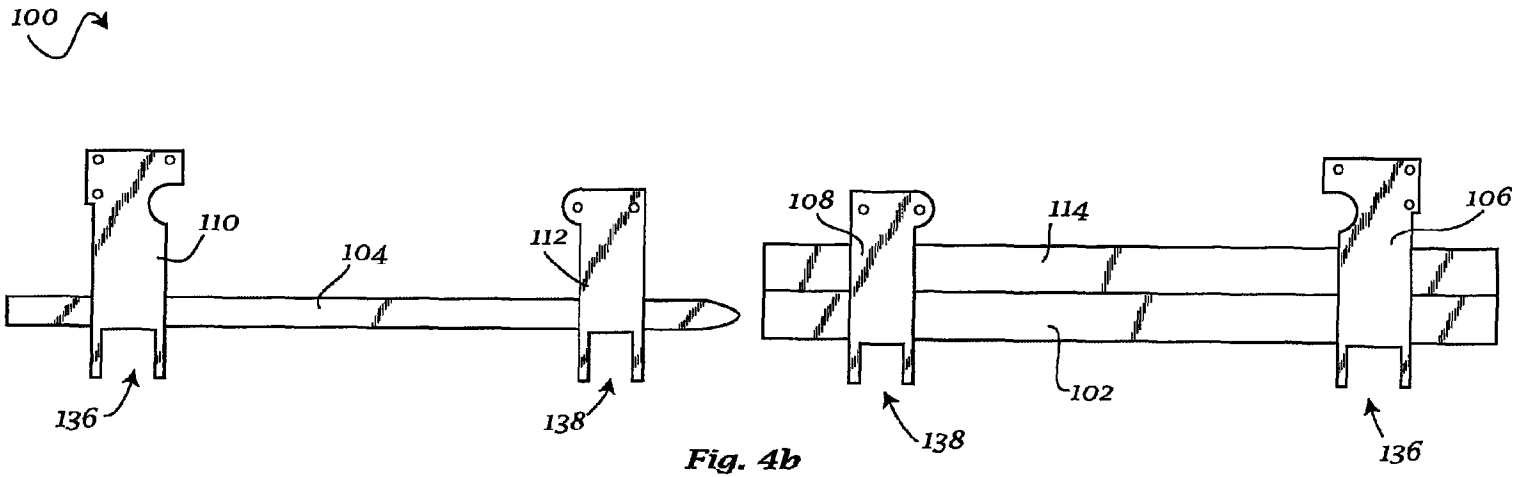
FIG. 4*b* is a rear elevational view of an exemplary embodiment of an adjustable width pallet and product protector in an extended configuration.

FIGS. 1*a*-1*b* shows an exemplary embodiment of an adjustable-width pallet and product protector 100 attached to a forklift 10 having a first pair of L-shaped forks 20 and a second pair of L-shaped forks 26. The first pair of L-shaped forks 20 can include an outer fork 22 and an inner fork 24. Similarly, the second pair of L-shaped forks 26 can include an outer fork 28 and an inner fork 30. Typically, forks 20, 26 can be a part of a carriage assembly 12. Carriage assembly 12 can be vertically adjustable, while each of forks 22, 24, 28, 30 can be laterally adjustable with respect to each other and to carriage assembly 12.

Generally referring to FIGS. 1*a*-4*b*, an exemplary embodiment of an adjustable-width pallet and product protector 100 may be shown. Pallet and product protector 100 may include a first horizontally elongated plate 102 and a second horizontally elongated plate 104 disposed rearwardly of first plate

102. Coupled to and disposed rearwardly of first horizontal plate 102 may be a first outer mounting plate 106 and a first inner mounting plate 108. Coupled to and disposed rearwardly of second horizontal plate may be a second outer mounting plate 110 and a second inner mounting plate 112. Mounting plates 106, 108, 110, 112 may further be disposed substantially coplanarly to each other. As first horizontal plate 102 is disposed generally forwardly of second horizontal plate 104, first horizontal plate 102 may include an offset portion 114, which may be disposed approximately coplanarly with second horizontal plate 104 and to which mounting plates 106, 108 may be coupled.

Figure 6B:
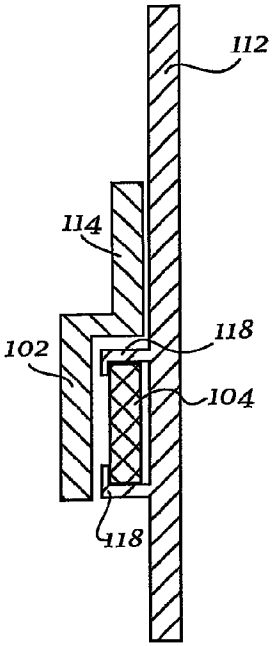
FIG. 6*b* is a cross-sectional view of another exemplary embodiment of an adjustable width pallet and product protector, along line B-B of FIG. 4*a*.
Figure 6A:
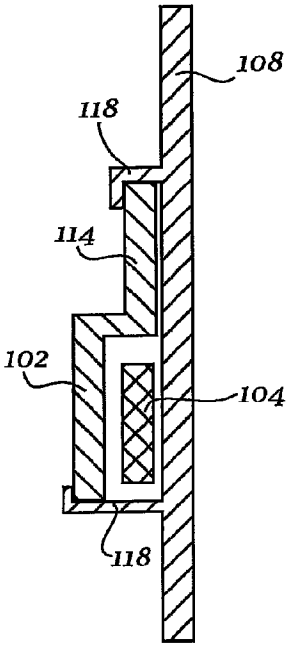
FIG. 6*a* is a cross-sectional view of another exemplary embodiment of an adjustable width pallet and product protector, along line A-A of FIG. 4*a*.
Figure 5B:
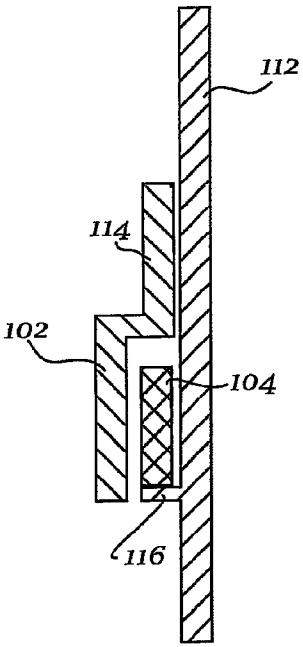
FIG. 5*b* is a cross-sectional view of an exemplary embodiment of an adjustable width pallet and product protector, along line B-B of FIG. 4*a*.
Figure 5A:
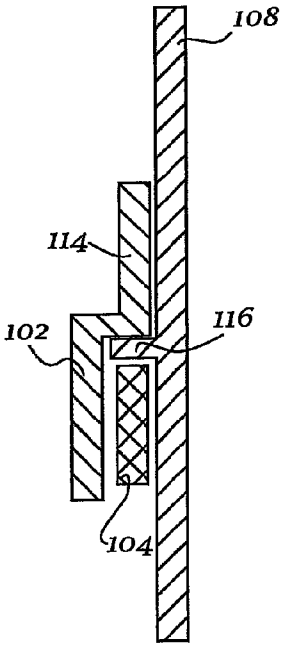
FIG. 5*a* is a cross-sectional view of an exemplary embodiment of an adjustable width pallet and product protector, along line A-A of FIG. 4*a*.

Outer mounting plates 106, 110 may be fixedly coupled to the respective horizontal plates 102, 104 while inner mounting plates 108, 112 may be slidably coupled to the respective horizontal plates 102, 104. The slidable coupling between the inner mounting plates and the horizontal plates may be any known slidable coupling. For example, in the illustrated embodiment, each of inner mounting plates 108, 112 may include an extension 116 on which the respective horizontal plate 102 or 104 may be disposed, as shown in FIGS. 5*a*-5*b*. Alternatively, the slidable coupling may be facilitated by at least one bracket 118, such that a horizontal plate is received between the at least one bracket 118 and the respective inner mounting plate 108 or 112, as shown in FIGS. 6*a*-6*b*. Furthermore, any known slidable coupling that enables protector 100 to function as described herein may be contemplated and provided as desired. Friction-reducing elements, such as bearings, low-friction coatings, or any other known friction-reducing element may also be provided as desired as part of the slidable coupling.

Each of inner mounting plates 108, 112 may be coupled to a respective inner fork 24, 30 of lift truck 10, while each of outer mounting plates 106, 110 may be coupled to a respective outer fork 22, 28 of lift truck 10. Coupling between the mounting plates and the forks may be facilitated by any known coupling means that enables protector 100 to function as described herein. In the illustrated embodiment, such coupling may be facilitated by the provision of apertures 120 within the mounting plates. Apertures 120 can receive fasteners 122 therethrough, which may be, for example threaded fasteners. Fasteners 122 can further couple with back plates 124, 126 disposed rearwardly of the forks of the lift truck 10. As the mounting plates are disposed forwardly of the forks, the tightening of fasteners 122 can clamp the forks between the mounting plates and the back plates, creating a friction fit that can facilitate securely coupling mounting plates 106, 108, 110, 112 to respective forks 22, 24, 28, 30.

In the illustrated embodiment, fasteners 122 may be disposed peripherally in relation to the forks, so as to reduce the likelihood of interference or contact between the fasteners and the forks. Therefore, a wider portion 128 of outer mounting plates 106, 110 can have a width that is greater than the width of the vertical portions of the forks, and, likewise, a wider portion 130 of inner mounting plates 108, 112 can have a width that is greater than the width of the vertical portions of the forks. The apertures 120 may consequently be provided within wider portions 128 or 130. Furthermore, to facilitate the above-described positioning of the fasteners in relation to the forks of the forklift, a tab 132 can be provided in the wider portion 128 of inner mounting plates 108, 112 and a complementary cutout 134 can be provided in the wider portion 130 of outer mounting plates 106, 110. Consequently, when the inner forks 24, 30 are adjusted with respect to outer forks 22, 28 such that the clearance between the inner and outer forks is minimized, the clearance between an inner mounting plate 106, 110 and an outer mounting plate 108, 112 may be maintained without interference between the plates while allowing for the positioning of fasteners 122 peripherally in relation to the forks.

The bottom portions of outer mounting plates 106, 110 can further include a cutout 136 within which a horizontal portion of a fork 22, 28 may be received. Similarly, the bottom portions of inner mounting plates 108, 112 can further include a cutout 138 within which a horizontal portion of a fork 24, 30 may be received. This can facilitate maintaining the inner and outer plates in fixed relation to the respective forks, and can reduce the likelihood of the mounting plates being pivoted, misaligned, or otherwise displaced during operation.

In operation, the protector 100 may be affixed to the carriage assembly 12 of a lift truck 10 as follows. The first horizontally elongated plate 102 may be coupled to the first pair of forks 20 by coupling the first outer mounting plate 106 of first horizontal plate 102 to the outer fork 22 of the first pair of forks 20, and coupling the first inner mounting plate 108 of first horizontal plate 102 to the inner fork 24 of the first pair of forks 20. Similarly, the second horizontally elongated plate 104 may be coupled to the second pair of forks 26 by coupling the second outer mounting plate 110 of second horizontal plate 104 to the outer fork 28 of the second pair of forks 26, and coupling the second inner mounting plate 112 of second horizontal plate 104 to the inner fork 30 of the second pair of forks 26. The couplings may be facilitated by the use of fasteners 122 and back plates 124, 126, substantially as described above. The vertical positioning of horizontally elongated plates 102, 104 may be such that sufficient vertical clearance is provided between plates 102, 104 so as to allow for the provision therebetween of any slidable couplings of plates 102, 104 to the respective inner mounting plates 108, 112. Furthermore, the vertical positioning of horizontally elongated plates 102, 104 may be such that the plates are positioned such that the plates impact the stringers of a pallet when the lift truck 10 is in operation.

When a lift truck 10 is in a single pallet configuration, the inner and outer forks 22, 24 of the first pair of forks 20 can be disposed substantially adjacent each other, and the inner and outer forks 28, 30 of the second pair of forks 26 can be likewise disposed substantially adjacent each other. Consequently, the second horizontal plate 104 can be disposed substantially rearwardly of first horizontal plate 102, providing an impact surface sufficient to protect a single-width pallet, or an object of similar dimensions. To accommodate objects having greater width, the lateral distance between the first pair of forks 20 and the second pair of forks 26 may be increased. Consequently, as this distance increases, second mounting plate 104 translates laterally from behind first mounting plate 102 so as to provide an additional impact surface sufficient to protect an object having greater width. To accommodate even wider objects, for example a double-width pallet, the distance between the inner forks 22, 24 and respective outer forks 28, 30 of each pair of forks 20, 26 may also be increased. Consequently, the distance between the outer mounting plates 106, 110 and the respective inner mounting plates 108, 118 may also increase, so as to provide an impact surface sufficient to protect a double-width pallet, or an object of similar dimensions. Furthermore, the slidable couplings between each of the horizontally elongated plates 102, 104 and the respective inner mounting plates 108, 112 facilitate supporting the horizontally elongated plates so as to reduce the likelihood of the plates 102, 104 being pivoted, misaligned, or otherwise displaced during operation.

The impact force can thus be distributed along a greater contact area than if the pallet were to be impacted solely by the vertical portions of forks 20, 22, 28, 30 and damage to the pallet may be prevented. Additionally, as the protector 100 is disposed forward of the forks and substantially at the height of the pallet when it is proximate to the forklift, any materials that are loaded on the pallet are not likely to come into contact with, or impact, the forks or the pallet protector, thereby reducing the likelihood of damage to the materials.

Figure 7:
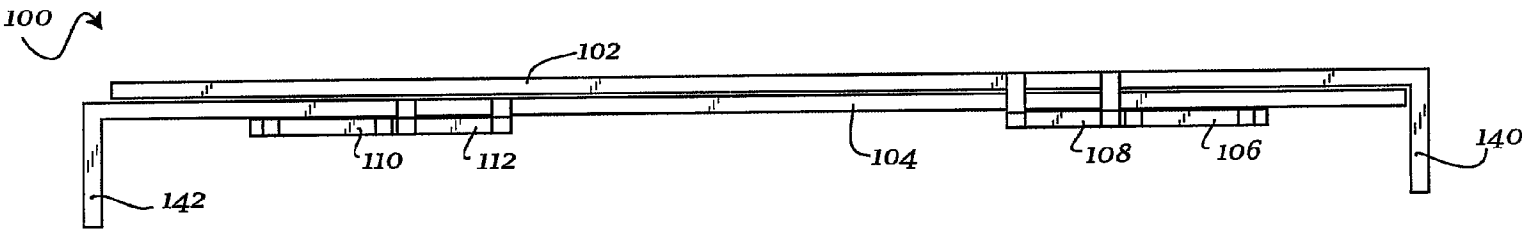
FIG. 7 is a bottom plan view of an exemplary embodiment of an adjustable width pallet and product protector in a retracted configuration.

During pallet loading and unloading operations, a forklift may approach the pallet at an oblique angle. Oblique impacts may also impart damage to the pallet and to the materials loaded thereon. Therefore, the exemplary embodiments of the adjustable-length pallet and product protector disclosed herein may include rearwardly extending portions 140, 142 disposed at the outer ends of the respective horizontally elongated plates 102, 104, as shown in FIG. 7. Such rearwardly extending portions can serve to reduce the likelihood of damage from oblique impacts by distributing the impact force over a greater contact area.

It should be appreciated that the exemplary embodiments of pallet protectors disclosed herein may include impact-absorbing members coupled thereto. Such impact absorbing members may be made out of any known impact absorbing material, for example a resiliently deformable material such as rubber, or foam. Furthermore, portions of the pallet protectors may be made from metal, plastic, wood, or any other desired material that enables the pallet protectors to function therein, or any combination of such materials.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An adjustable width pallet and product protector for mounting on a front of a lift truck having a first outer L-shaped fork, a first inner L-shaped fork, a second outer L-shaped fork, and a second inner L-shaped fork, comprising:

a first horizontally elongated plate;

a second horizontally elongated plate disposed rearwardly of the first horizontally elongated plate, wherein the first horizontally elongated plate and the second horizontally elongated plate are disposed in front of the first outer L-shaped fork, the first inner L-shaped fork, the second outer L-shaped fork, and the second inner L-shaped fork;

a first outer mounting plate disposed rearwardly of and coupled to the first horizontally elongated plate;

a first inner mounting plate disposed rearwardly of and slidably coupled to the first horizontally elongated plate;

a second outer mounting plate disposed rearwardly of and coupled to the second horizontally elongated plate; and a second inner mounting plate disposed rearwardly of and slidably coupled to the second horizontally elongated plate;

as the distance between the first outer L-shaped fork and the first inner L-shaped fork increases, the first horizontally elongated plate translates laterally so as to provide an impact surface forwardly of and between the first outer L-shaped fork and the first inner L-shaped fork; and as the distance between the second outer L-shaped fork and the second inner L-shaped fork increases, the second horizontally elongated plate translates laterally so as to provide an impact surface forwardly of and between the second outer L-shaped fork and the second inner L-shaped fork.

2. The adjustable width pallet and product protector of claim 1, wherein:

the first outer mounting plate is adapted to couple to the first outer L-shaped fork;

the first inner mounting plate is adapted to couple to the first inner L-shaped fork;

the second outer mounting plate is adapted to couple to the second outer L-shaped fork; and the second inner mounting plate is adapted to couple to the second inner L-shaped fork.

3. The adjustable width pallet and product protector of claim 1, wherein the first horizontally elongated plate comprises an offset portion, the offset portion being disposed substantially coplanarly with the second horizontally elongated plate.

4. The adjustable width pallet and product protector of claim 1, wherein each of the mounting plates comprises a wider portion having a width greater than the width of the respective L-shaped fork.

5. The adjustable width pallet and product protector of claim 4, wherein:

the wider portion of each of the inner mounting plates comprises a tab; and the wider portion of each of the outer mounting plates comprises a complementary cutout for receiving the tab.

6. The adjustable width pallet and product protector of claim 4, further comprising a plurality of back plates disposed rearwardly of the L-shaped forks and adapted to couple to the respective mounting plates so as to clamp the L-shaped forks between the mounting plates and the back plates.

7. The adjustable width pallet and product protector of claim 1, wherein each of the mounting plates comprises a cutout for receiving a horizontal portion of the respective L-shaped fork.

8. The pallet protector of claim 1, further comprising:

a rearwardly extending portion disposed at the outer end of the first horizontal plate; and a rearwardly extending portion disposed at the outer end of the second horizontal plate.

* * * * *